US009664042B2

(12) United States Patent
Schmidt

(10) Patent No.: US 9,664,042 B2
(45) Date of Patent: May 30, 2017

(54) ANCHOR, ESPECIALLY A ROCK ANCHOR

(71) Applicant: Hilti Aktiengesellschaft, Schaan (LI)

(72) Inventor: Frank Schmidt, Munich (DE)

(73) Assignee: Hilti Aktiengesellschaft, Schaan (LI)

( * ) Notice: Subject to any disclaimer, the term of this patent is extended or adjusted under 35 U.S.C. 154(b) by 14 days.

(21) Appl. No.: 14/360,755

(22) PCT Filed: Oct. 17, 2012

(86) PCT No.: PCT/EP2012/070546
§ 371 (c)(1),
(2) Date: May 27, 2014

(87) PCT Pub. No.: WO2013/079254
PCT Pub. Date: Jun. 6, 2013

(65) Prior Publication Data
US 2014/0334885 A1 Nov. 13, 2014

(30) Foreign Application Priority Data
Nov. 28, 2011 (DE) ..... 10 2011 087 178

(51) Int. Cl.
*E21D 21/00* (2006.01)
*E21D 20/02* (2006.01)

(52) U.S. Cl.
CPC ..... *E21D 21/0026* (2013.01); *E21D 20/02* (2013.01); *E21D 21/008* (2013.01); *E21D 21/0046* (2013.01)

(58) Field of Classification Search
CPC . E21D 21/0026; E21D 20/02; E21D 21/0046; E21D 21/008; E21D 2021/0053; E21D 2021/0066; E21D 20/00; E21D 21/00; F16B 35/044; F16B 13/003; F16B 13/0858; F16B 13/141; E02D 5/808
USPC ..... 411/387.4
See application file for complete search history.

(56) References Cited

U.S. PATENT DOCUMENTS 2,993,950 A * 7/1961 Forman ..... F16B 25/0094 174/138 D
4,553,279 A * 11/1985 Gassew ..... A46B 17/06 15/105
5,044,832 A * 9/1991 Gruber ..... E02D 5/76 405/236
5,433,558 A * 7/1995 Gray ..... E21D 21/0053 405/259.1
5,735,653 A * 4/1998 Schiefer ..... E21D 21/0026 405/259.6
7,896,580 B2 3/2011 Weaver et al.
9,097,112 B2 * 8/2015 Meline ..... E02D 5/808
(Continued)

FOREIGN PATENT DOCUMENTS

DE 20 63 843 6/1972
DE 297 07 502 6/1997
(Continued)

*Primary Examiner* — Benjamin Fiorello
*Assistant Examiner* — Carib Oquendo
(74) *Attorney, Agent, or Firm* — Davidson, Davidson & Kappel, LLC

(57) ABSTRACT

An anchor fitted with a self-tapping thread and an anchor rod, whereby at least one axially oriented feed channel for a curable compound is arranged in the anchor rod. A head element on which the self-tapping thread is arranged is fastened to a first end of the anchor rod.

12 Claims, 1 Drawing Sheet

(56) References Cited

U.S. PATENT DOCUMENTS

| | | | | |
|---|---|---|---|---|
| 2002/0081159 | A1* | 6/2002 | Xu | E21D 21/00 405/259.1 |
| 2008/0050198 | A1* | 2/2008 | Ayrle | F16B 13/002 411/386 |
| 2009/0092446 | A1 | 4/2009 | Bayerl et al. | |
| 2011/0052332 | A1* | 3/2011 | Oldsen | E21D 21/0006 405/259.6 |
| 2011/0070035 | A1* | 3/2011 | Ricardo | E21D 20/02 405/259.5 |
| 2011/0206468 | A1 | 8/2011 | Ayrle | |

FOREIGN PATENT DOCUMENTS

| | | | | |
|---|---|---|---|---|
| DE | 10 2007 000 829 | | 4/2009 | |
| DE | 10 2010 002 214 | | 8/2011 | |
| EP | 1892426 | | 2/2008 | |
| WO | WO2009/079684 | | 7/2009 | |
| WO | WO2010/079277 | * | 7/2010 | E21D 20/028 |

* cited by examiner

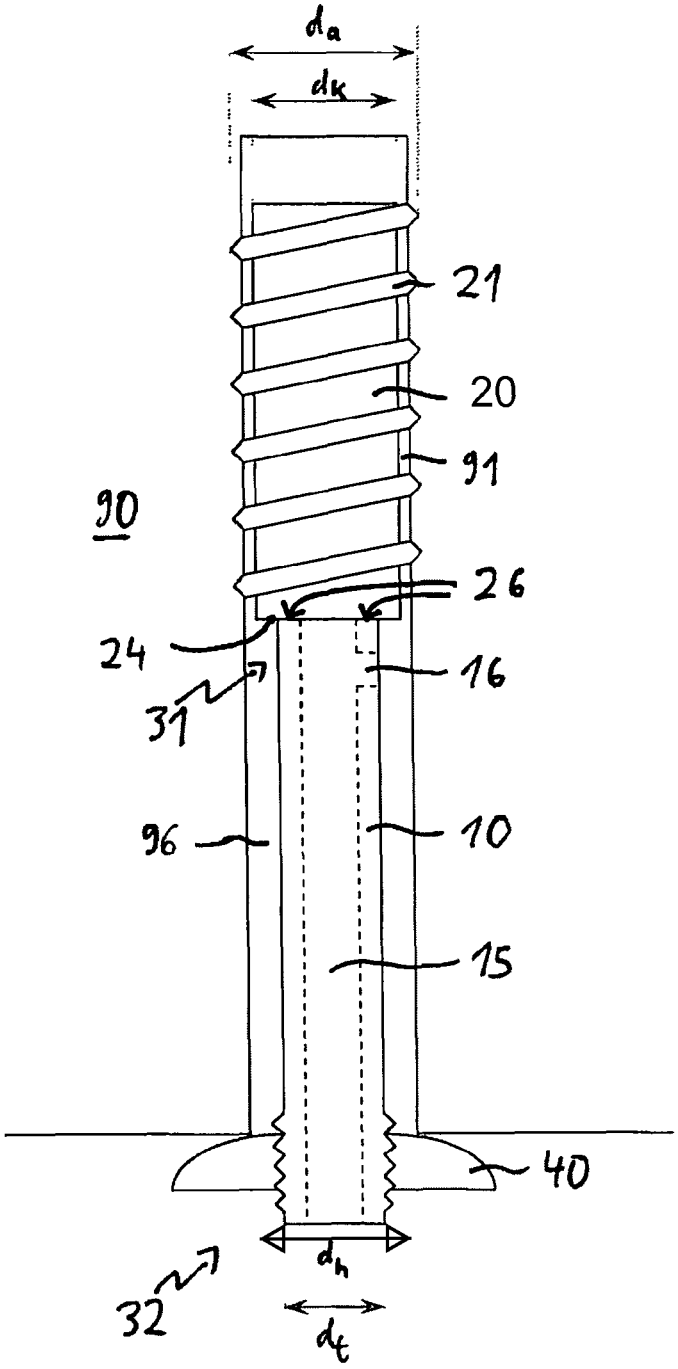
$d_a$
$d_k$
21
20
91
90
26
24
16
31
96
10
15
40
$d_h$
32
$d_t$

ANCHOR, ESPECIALLY A ROCK ANCHOR

CROSS-REFERENCE TO RELATED APPLICATIONS

This is a National Phase Application of International Application PCT/2012/070546, filed Oct. 17, 2012 which claims the benefit of German Patent Application DE102011087178.0, filed Nov. 28, 2011, all of which are hereby incorporated by reference herein.

STATEMENT REGARDING FEDERALLY SPONSORED RESEARCH OR DEVELOPMENT

N/A

THE NAMES OF THE PARTIES TO A JOINT SPONSORED RESEARCH OR DEVELOPMENT

N/A

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

N/A

STATEMENT REGARDING PRIOR DISCLOSURES BY THE INVENTOR OR A JOINT INVENTOR

N/A

The present invention relates to an anchor, especially to a rock anchor. Such an anchor is fitted with a self-tapping thread and an anchor rod, whereby at least one axially oriented feed channel for a curable compound is arranged in the anchor rod.

BACKGROUND OF THE INVENTION

When it comes to the mining sector, U.S. Pat. No. 7,896,580 B, for example, discloses an anchor with expansion heads. The expansion heads are installed, especially screwed, like a sleeve onto the anchor rod (typically a solid rod, rarely a hollow rod) at the end facing the ground and they expand inside the substrate when screwed or pulled after the anchor has been put in place.

The diameter of the drilled hole needed for the installation of the expansion-head anchor, however, is often relatively large, e.g. 32 mm to 34 mm for a 16-mm anchor rod, which can especially be due to a relatively complex structure of the expansion head which takes up a lot of space. In certain cases, this can also give rise to problems when the relatively large heads are inserted into the drilled hole, particularly when the drilled hole is unstable or not completely straight. Moreover, the force introduction of an expansion head, owing to its fundamental shape as well as to tolerance fluctuations, is often very punctiform, so that in certain cases, especially with a weak geological formation, the compressive stress that the surrounding rock can withstand might be exceeded. Furthermore, before the anchor has been installed, expansion heads are sometimes not very sturdy since they consist of several parts that are often only held together loosely. Only after the expansion effect has been activated are the individual components held together positively as well as non-positively. This means that, under certain conditions, the expansion sleeves can be damaged when the anchor is transported underground.

German patent applications DE 20 63 843 A and DE 10 2010 002 214 A also disclose screws that are made of solid material and that are anchored punctiformly at the end of the drilled hole.

German patent application DE 10 2007 000 829 A discloses an anchor tube whose interior contains a curable compound. The curable compound is dispensed into the drilled hole, thus securing the anchor tube in the drilled hole.

German utility model DE 297 07 502 U1 discloses a screw-injection anchor whose lower end has an anchor tube fitted with a fixing nut which can be screwed into the ground, whereby a hydraulic mortar can be injected through the anchor tube into the surrounding ground via openings in the tube wall.

BRIEF SUMMARY OF THE INVENTION

It is an objective of the present invention to provide an anchor, especially a rock anchor, that is very easy to handle, inexpensive and reliable.

The present invention provides an anchor having a head element on which the self-tapping thread is arranged, the head being fastened to a first end of the anchor rod, especially to the end facing the ground.

The invention is based on a combination of a screw anchor that can be frictionally secured and an adhesive anchor, thus combining the advantages of a classic mining expansion-head anchor—which allows immediate bonding to the rock—and of a screw anchor system—which allows the use of a drilled hole that has a small diameter and that is configured so as to be sturdy and have few parts—with the advantages of an adhesive system. A first underlying idea of the invention can be seen in that the essential elements of the adhesive anchor and the essential elements of the screw anchor are each to be provided in separate elements: whereas the feed channel is located exclusively in the anchor rod, the self-tapping thread is arranged exclusively on an element that is separate from the anchor rod, namely, the head element. Owing to this separation, the anchor can be manufactured particularly inexpensively and with great reliability.

Preferably, the outer diameter of the thread arranged on the head element is greater than the diameter of the anchor rod. This ensures a reliable placement procedure of the anchor and a defined introduction of force prior to the application of the curable compound. It is particularly preferred for the core diameter of the thread arranged on the head elements to be greater than the diameter of the anchor rod. In this embodiment, the head element can form a ring-shaped axial stop that is in contact with the cured compound, translating into particularly good introduction of tractive force.

Moreover, it is particularly preferred for the feed channel and the thread to be at an axial distance from each other. This makes it possible to further reduce the manufacturing work involved since in this case, the geometry of the anchor rod and of the head element can be configured to be very simple. Fundamentally speaking, however, it is also possible to configure the feed channel and the thread so that they overlap axially, for example, in that a recess for the anchor rod is provided on the head element. The term axial direction as set forth in the invention refers to the lengthwise direction of the anchor, especially of the anchor rod.

In a practical manner according to the invention, the anchor rod is provided with a preferably radial outlet bore that leads from the feed channel to the outside of the anchor rod. This allows the ring-shaped space around the anchor rod to be filled with the curable compound in a particularly simple and reliable manner. The outlet bore is advantageously located just before the first end of the anchor rod, that is to say, before the end where the head element is located. In particular, this can mean that the distance between the outlet bore and the first end is smaller than ten times, five times or one time the diameter of the anchor rod. This is especially advantageous from the standpoint of flow mechanics. Additional outlet bores which are at a greater distance from the first end can also be provided.

The construction effort involved can be further reduced in that the feed channel is closed off by the head element. Accordingly, the head element not only serves as the support of the thread, but it also has a flow-mechanical function in that it seals off the feed channel at the end face of the anchor rod.

Especially with an eye towards achieving an excellent force absorption and reducing the manufacturing work, it is advantageous for the head element to be made of a solid material. This means that the head element is configured so as to be solid.

The anchor rod and/or the head element are preferably made of metal, especially steel. The anchor rod which, due to its interior feed channel, can also be referred to as an anchor tube, is advantageously joined to the head element so as to abut with it. For instance, with an eye towards reducing the manufacturing costs, it is advantageous for the anchor rod and the head element to be joined by means of a welded connection, especially by means of a frictional welded connection. Owing to the inventive geometry of the individual parts, such a connection can be created very easily. Instead of a welded connection, a screwed connection is also conceivable.

In order to pre-tension the anchor and/or to fasten additional elements, it is advantageous for an anchor nut to be arranged on the end section of the anchor rod facing away from the first end.

The invention also relates to the proper use of the anchor, in which the anchor is accommodated in a hole drilled in the rock, whereby the thread of the head element is screwed into the rock surrounding the drilled hole and the anchor rod is surrounded by a compound that has cured. The hole drilled in the rock can be configured so as to be cylindrical or as a stepped bore hole. After the anchor has been screwed into the pre-drilled hole, curable compound (e.g. cement mortar) is introduced via the feed channel that is located inside the anchor rod. The compound rises all the way to the area of the first end of the anchor rod, after which it exits via the at least one radial outlet bore and steadily fills the ring-shaped space in the drilled hole downwards until it once again exits at the opening of the drilled hole.

According to the invention, the self-tapping thread is provided exclusively on the head element and it does not extend to the anchor rod. The anchor rod can be configured so as to be smooth on its outer circumferential surface or else it can be profiled with an eye towards achieving excellent force introduction into the cured compound. If the anchor rod is profiled on its outer circumferential surface, this profiling can also be configured as a thread. According to the invention, the thread-like profiling, however, can be configured with thread parameters that differ from those of the self-tapping thread on the head element, or else it is configured so as to be discontinuous with respect to the self-tapping thread and/or, especially, so as not to be self-tapping.

BRIEF DESCRIPTION OF THE SEVERAL VIEWS OF THE DRAWINGS

The invention will be described in greater detail below making reference to a preferred embodiment that is schematically depicted in the accompanying FIGURE. The following is shown schematically:

FIG. 1: a side view of an anchor according to the invention, in a hole drilled in the rock, whereby the rock that surrounds the drilled hole is shown in a cutout view.

DETAILED DESCRIPTION OF THE INVENTION

One embodiment of an anchor according to the invention is shown in FIG. 1. The anchor is arranged in a hole 91 that has been drilled into the rock 90. The anchor has an approximately cylindrical anchor rod 10 on whose first end 31—on the drilled hole side—a head element 20 is fastened. The anchor rod 10 and the head element 20 are joined by means of a frictional welded connection 26 so as to abut with each other.

On the outside of the cylindrical head element 20, there is a self-tapping external thread 21. The thread 21 has an outer diameter $d_a$ that is greater than the inner diameter $d_h$ of the drilled hole 91, that is to say, the thread 21 is cut into the rock 90 that surrounds the drilled hole 91.

The core diameter $d_k$ of the thread 21, which is defined by the circumferential surface of the cylindrical head element 20, is greater than the outer diameter $d_t$ of the anchor rod 10. A ring-shaped step 24 is formed at the transition site between the anchor rod 10, whose diameter is smaller, and the head element 20, whose diameter is greater.

Since the outer diameter $d_t$ of the anchor rod 10 in the drilled hole 91 is smaller than the inner diameter $d_h$ of the drilled hole 91, the anchor rod 10 in the drilled hole 91 is surrounded by a ring-shaped space 96. This ring-shaped space 96 can be filled with a curable compound in order to additionally secure the anchor, whereby the curable compound can especially be introduced after the anchor has been pre-tensioned in the drilled hole 91. For purposes of introducing the curable compound into the ring-shaped space 96, the inside of the anchor rod 10 configured as an anchor tube has a feed channel 15 that runs axially, in other words, in the lengthwise direction of the anchor rod 10, said feed channel 15 being indicated by the broken lines in the FIGURE. Opening into this feed channel 15, there is at least one radial outlet bore 16 that is provided in the area of the first end 31 of the anchor rod 10 and that leads to the outside of the anchor rod 10.

The end section 32 of the anchor rod 10 faces the outside and is opposite from the first end 31 of the anchor rod 10, the latter being provided with an external thread on which an anchor nut 40 is arranged.

The invention claimed is:

1. An anchor comprising:

an anchor tube having at least one axially oriented feed channel for a curable compound;

a head element fastened to a first end of the anchor tube; and a self-tapping thread arranged on the head element;

the head element closing off the at least one axially-oriented feed channel wherein the anchor tube is provided with at least one radial outlet bore leading from the feed channel to an outside of the anchor tube.

2. The anchor as recited in claim 1 wherein a core diameter of the self-tapping thread arranged on the head element is greater than a diameter of the anchor tube.

3. The anchor as recited in claim 1 wherein the feed channel and the self-tapping thread are at an axial distance from each other.

4. The anchor as recited in claim 1 wherein the anchor tube is provided with at least one radial outlet bore leading from the feed channel to an outside of the anchor tube.

5. The anchor as recited in claim 1 wherein the feed channel is closed off by the head element.

6. The anchor as recited in claim 1 wherein the anchor tube and the head element are joined by a welded connection.

7. The anchor as recited in claim 6 wherein the welded connection is a frictional welded connection.

8. The anchor as recited in claim 1 wherein the head element is solid.

9. The anchor as recited in claim 1 further comprising an anchor nut arranged on an end section of the anchor tube facing away from the first end.

10. The anchor as recited in claim 1 wherein the at least one radial outlet bore is a single radial outlet bore in the anchor tube before the first end.

11. A method for inserting the anchor as recited in claim 1 comprising accommodating the anchor in a hole drilled in rock.

12. The method as recited in claim 11 further comprising screwing the self-tapping thread of the head element into the rock and surrounding the anchor rod with a cured compound.

* * * * *